US009390842B2

(12) United States Patent
Hayashishita et al.

(10) Patent No.: US 9,390,842 B2
(45) Date of Patent: Jul. 12, 2016

(54) MULTI-CORE CABLE AND ITS MANUFACTURING METHOD

(71) Applicant: SUMITOMO ELECTRIC INDUSTRIES, LTD., Osaka-shi, Osaka (JP)

(72) Inventors: Tatsunori Hayashishita, Hachinohe (JP); Yuuki Isoya, Hachinohe (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 122 days.

(21) Appl. No.: 14/186,555

(22) Filed: Feb. 21, 2014

(65) Prior Publication Data

US 2014/0238722 A1 Aug. 28, 2014

(30) Foreign Application Priority Data

Feb. 22, 2013 (JP) ..... 2013-032892

(51) Int. Cl.

| | |
|---|---|
| ***H01B 11/02*** | (2006.01) |
| ***H01B 13/34*** | (2006.01) |
| ***H01B 11/20*** | (2006.01) |
| *H01B 11/18* | (2006.01) |
| *H01B 13/02* | (2006.01) |

(52) U.S. Cl.

CPC ..... *H01B 13/34* (2013.01); *H01B 11/20* (2013.01); *H01B 11/1891* (2013.01); *H01B 13/02* (2013.01); *Y10T 29/49117* (2015.01)

(58) Field of Classification Search

USPC ..... 174/102 R, 107, 108, 109 R, 110 R, 174/113 R, 36, 28

See application file for complete search history.

(56) References Cited

U.S. PATENT DOCUMENTS

| | | | | |
|---|---|---|---|---|
| 3,489,844 | A * | 1/1970 | Motley | 174/32 |
| 4,536,327 | A * | 8/1985 | Ramisse et al. | 252/511 |
| 4,552,989 | A * | 11/1985 | Sass | 174/103 |
| 5,418,878 | A * | 5/1995 | Sass et al. | 385/101 |
| 5,902,958 | A * | 5/1999 | Haxton | 174/47 |
| 5,976,070 | A * | 11/1999 | Ono et al. | 600/110 |
| 6,479,753 | B2 * | 11/2002 | Borg et al. | 174/113 R |
| 7,060,905 | B1 * | 6/2006 | McMahon | 174/110 R |
| 7,417,187 | B2 * | 8/2008 | Tanaka et al. | 174/47 |
| 7,622,679 | B2 * | 11/2009 | Huang et al. | 174/107 |
| 8,957,312 | B2 * | 2/2015 | McCullough et al. | 174/113 R |
| 2008/0314613 | A1 * | 12/2008 | Huang et al. | 174/107 |

FOREIGN PATENT DOCUMENTS

| | | |
|---|---|---|
| CN | 101325099 B | 6/2011 |
| CN | 102097161 A | 6/2011 |
| CN | 102592744 A | 7/2012 |
| CN | 202677958 U | 1/2013 |

(Continued)

*Primary Examiner* — William H Mayo, III

(74) *Attorney, Agent, or Firm* — Drinker Biddle & Reath LLP

(57) ABSTRACT

There is provided a multi-core cable including: first insulated wires; second insulated wires; coaxial wire pairs; and a sheath. The second insulated wires are smaller in diameter than the first insulated wires. The coaxial wire pairs are provided in an even number of pairs. The first insulated wires and the coaxial wire pairs are arranged close to each other on a single circle in a cross section, and the second insulated wires are disposed thereinside. The first insulated wires, the second insulated wires and the coaxial wire pairs are wholly twisted, and then, wholly covered by the sheath.

6 Claims, 2 Drawing Sheets

(56) References Cited

FOREIGN PATENT DOCUMENTS

| | | | | | |
|---|---|---|---|---|---|
| JP | 5-258620 | | * | 10/1993 | ..... H01B 11/20 |
| JP | 2006-196289 | A | | 7/2006 | |
| JP | 2007-188738 | A | * | 7/2007 | ..... H01B 11/06 |
| JP | 2007-188738 | A | | 7/2007 | |
| JP | 4110382 | B2 | | 7/2008 | |
| JP | UM-3145818 | B | | 10/2008 | |
| JP | 2008-311120 | A | | 12/2008 | |
| TW | 2012-39902 | A | | 10/2012 | |
| WO | WO-2012-105142 | A | | 8/2012 | |

* cited by examiner

MULTI-CORE CABLE AND ITS MANUFACTURING METHOD

CROSS-REFERENCE TO RELATED APPLICATION(S)

This application claims priority from Japanese Patent Application No. 2013-032892 filed on Feb. 22, 2013, the entire contents of which are incorporated herein by reference.

FIELD

An aspect of the present invention relates to a multi-core cable having plural insulated wires and plural coaxial wires as well as to its manufacturing method.

BACKGROUND

For example, JP-4110382-B proposes a multi-core cable in which plural coaxial wires are arranged on a single circle in a transverse cross section.

Although such multi-core cable may be initially designed to arrange plural coaxial wires on a single circle, theses coaxial wires may deviate from its prescribed position as a result of being twisted together. If positional deviations of the coaxial wires arise, wire rearrangement work of rearranging the positions of the coaxial wires becomes necessary in connecting the end portion of the multi-core cable to a counterpart connection member such as a connector. This complicates the termination work for the multi-core cable and results in cost increase.

SUMMARY

In view of above, following inventive aspects are defined.

Aspect 1 defines a multi-core cable including:

first insulated wires;

second insulated wires which are smaller in diameter than the first insulated wires;

coaxial wire pairs including an even number of pairs of coaxial wires; and a sheath which wholly covers the first insulated wires, the second insulated wires and the coaxial wire pairs, wherein the first insulated wires and the coaxial wire pairs are arranged close to each other on a single circle in a cross section taken perpendicularly to a cable longitudinal direction of the multi-core cable, wherein the second insulated wires are disposed inside the circular arrangement of the first insulated wires and the coaxial wire pairs, and wherein the first insulated wires, the second insulated wires and the coaxial wire pairs are wholly twisted.

Aspect 2 defines the multi-core cable of Aspect 1, wherein the first insulated wires are arranged on the single circle at equal intervals, and wherein the coaxial wire pairs are disposed between the first insulated wires which are spaced from each other.

Aspect 3 defines the multi-core cable of Aspect 1, wherein each of the coaxial wires includes an inner conductor, an insulator, an outer conductor, and a sheath, and wherein the insulator is made of a fluororesin containing carbon black at 0.15 to 0.35 wt %.

Aspect 4 defines a manufacturing method of a multi-core cable including:

arranging first insulated wires and coaxial wire pairs including an even number of pairs of coaxial wires close to each other on a single circle in a cross section taken perpendicularly to a cable longitudinal direction;

disposing second insulated wires which are smaller in diameter than the first insulated wires inside the circular arrangement of the first insulated wires and the coaxial wire pairs;

wholly twisting the first insulated wires, the second insulated wires and the coaxial wire pairs; and after twisting, wholly coving the first insulated wires, the second insulated wires and the coaxial wire pairs.

Aspect 5 defines the manufacturing method of Aspect 4, wherein the first insulated wires and the coaxial wire pairs are arranged on the single circle such that the first insulated wires are arranged on the single circle at equal intervals, and wherein the coaxial wire pairs are disposed between the first insulated wires which are spaced from each other.

According to the above inventive aspects, since the second insulated wires are disposed inside the circular arrangement of the first insulated wires and the coaxial wire pairs, the wires can be disposed efficiently in a narrow space. This enables miniaturization of the multi-core cable. Further, since the coaxial wires can be arranged close to each other on the single circle without positional deviations, the multi-core cable can be terminated easily and the processing cost can be reduced.

DETAILED DESCRIPTION

An example multi-core cable and an example manufacturing method thereof according to an embodiment will be described with reference to the drawings.

Figure 1:
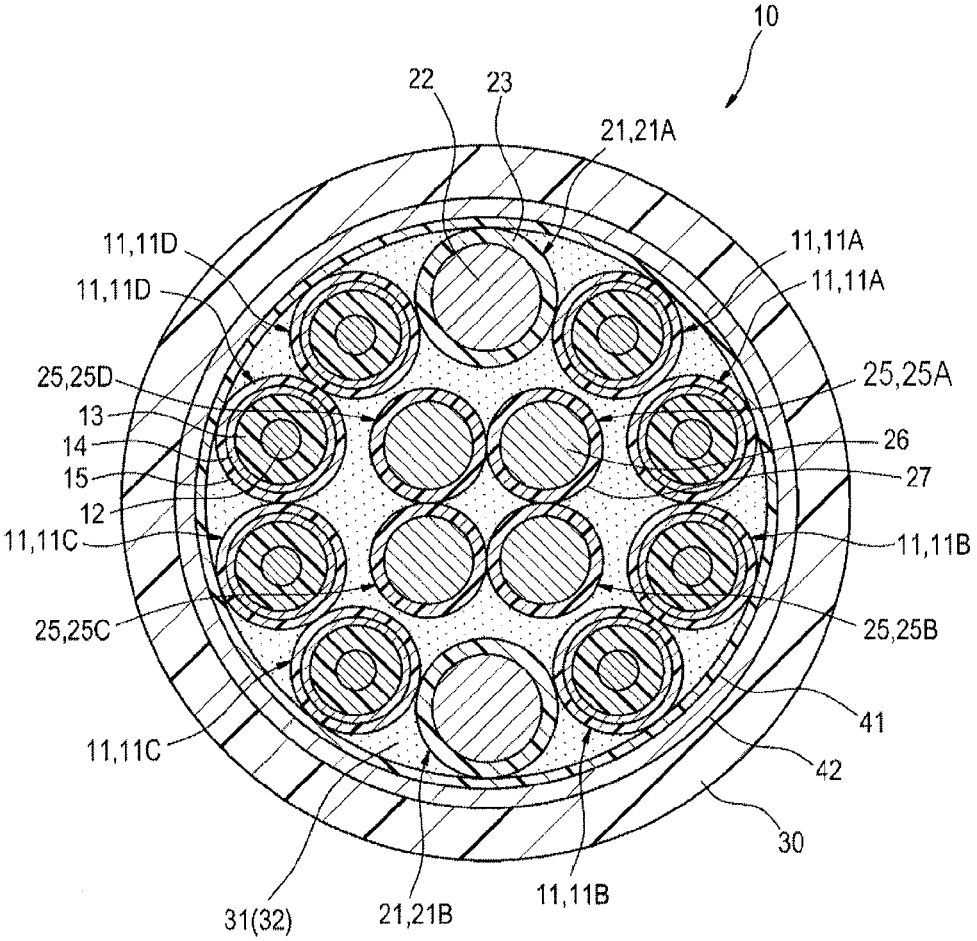
FIG. 1 is a sectional view of an example multi-core cable according to an embodiment.

As shown in FIG. 1, a multi-core cable 10 according to the embodiment has, inside an overall sheath 30 which is the outermost layer, plural coaxial wires 11 for high-speed transmission and plural insulated wires 21 and 25 for power supply or low-speed signal transmission.

The multi-core cable 10 incorporates pairs of coaxial wires 11 so as to be suitable for a differential transmission purpose. More specifically, the multi-core cable 10 incorporates an even number of (in this example, four) pairs of coaxial wires 11, that is, coaxial wire pairs 11A-11D. It is preferable that the coaxial wires 11 constituting each coaxial wire pair (e.g., coaxial wire pair 11A) be disposed close to each other. The multi-core cable 10 also incorporates, as the insulated wires 21 and 25, insulated wires 21A and 21B and insulated wires 25A-25D. It is preferable that about four to 16 coaxial wires 11 constitute the even number of coaxial wire pairs 11A-11D. It is also preferable that about two to six insulated wires 21 and about four to nine insulated wires 25 be provided.

Each coaxial wire 11 is configured such that an inner conductor 12 is covered with an insulator 13, an outer conductor 14 is provided outside the insulator 13, and the outer conductor 14 is covered with and protected by a sheath 15. Coaxial wires narrower than those of AWG (American wire gauge) 30 are used as the coaxial wires 11 for high-speed transmission. This example employs small-diameter coaxial wires of AWG #36.

For example, the inner conductor 12 is a twisted wire consisting of plural silver-plated annealed copper wires that are twisted together.

For example, the insulator 13 is made of a resin material that has, as a base material, a tetrafluoroethylene-hexafluoropropylene copolymer (FEP) and contains carbon black at 0.15 to 0.35 wt % (preferably 0.25 wt %). The insulator 13 is formed by subjecting this material to extrusion molding.

To facilitate termination and wiring work, it is preferable that the insulators 13 of the respective coaxial wires 11 be colored differently, that is, contain pigments of different colors. In the embodiment, as described above, it is desirable to give the insulators 13 light black colors by, for example, adding carbon black to a fluororesin base material at 0.15 to 0.35 wt %. The permittivity of the insulator 13 in the cable longitudinal direction varies depending on the pigment contained therein and influences the skew of the coaxial wire 11. When the outer conductor 14 is cut using a YAG laser in terminating a coaxial wire 11, the insulator 13 or the inner conductor 12 may be damaged if the insulator 13 contains a certain pigment. It is necessary to prevent damaging of the insulator 13 or the inner conductor 12, and to make the skew smaller than or equal to 16 ps/m. The degree of damage of the insulator 13 or the inner conductor 12 that occurs when the outer conductor 14 is cut using a YAG laser can be lowered by adding carbon black to a fluororesin base material of the insulator 13 at 0.15 to 0.35 wt %, as is done in the embodiment.

For example, the outer conductor 14 is formed by spirally wrapping a tin-plated annealed copper wire around the outer circumferential surface of the insulator 13. For example, the sheath 15 is formed by doubly spirally wrapping a resin tape made of polyethylene terephthalate (PET). The outer diameter of the sheath 15 is set at about 0.6 mm, for example.

The outer conductors 14 of coaxial wires 11 configured in the above-described manner were cut using a YAG laser or the like, to produce a result that no damage was found in the insulators 13 or the inner conductors 12. They showed tensile strength values of 40 kg or more, which mean sufficiently high mechanical strength.

Each of the insulated wires 21 (first insulated wires) is a wire in which a conductor 22 is covered with a sheath 23. For example, the conductor 22 is a twisted wire of tin-plated annealed copper wires. It is preferable that the sheath 23 be made of a fluororesin such as a perfluoroalkoxy resin (PFA) which is superior in heat resistance, chemical resistance, non-adhesiveness, self-lubricity, etc. The outer diameter of the sheath 23 is about 0.8 mm, for example, and hence is larger than that of the coaxial wire 11 for high-speed transmission.

Each of the insulated wires 25 (second insulated wires) is a wire in which a conductor 26 is covered with a sheath 27. Like the conductor 22 of the insulated wire 21, the conductor 26 is a twisted wire of tin-plated annealed copper wires. It is preferable that the sheath 27 be made of a fluororesin such as a perfluoroalkoxy resin (PFA). The outer diameter of the sheath 27 is smaller than that of the sheath 23 of the insulated wire 21, and is about 0.58 mm, for example.

In the above-described multi-core cable 10 which have the insulated wires 21 and 25 and the coaxial wire pairs 11A-11D (even number of pairs of coaxial wires 11) for high-speed transmission, the coaxial wires 11 and the large-diameter insulated wires 21 are arranged close to each other on a single circle in a transverse cross section (see FIG. 1) taken perpendicularly to the cable longitudinal direction. The plural (in this example, two) large-diameter insulated wires 21 are arranged at equal intervals and an even number of (two) coaxial wire pairs 11A and 11B or 11C and 11D are arranged between the insulated wires 21 on each side. It is appropriate to arrange the even number of coaxial wire pairs 11A-11D such that one or an even number of coaxial wire pairs are arranged between the plural insulated wires 21 (arranged at equal intervals) on each side. The large-diameter insulated wires 21 and the coaxial wire pairs 11A-11D are arranged so as to be as symmetrical as possible with respect to the center of the multi-core cable 10 which looks circular in a cross section taken perpendicularly to the longitudinal direction (see FIG. 1).

The large-diameter insulated wires 21 need not always be arranged so as to be spaced from each other. For example, where three large-diameter insulated wires 21 exist, they may be arranged such that two of them are arranged adjacent to each other and the other wire is disposed at the position that is symmetrical with the two wires with respect to the center of the circle (cable center) in a cable cross section (i.e., spaced from the center of the two wires by 180°). The coaxial wire pairs (11A and 11B or 11C and 11D) are disposed between those large-diameter insulated wires 21 as equally as possible.

The small-diameter insulated wires 25A-25D are arranged close to each other inside the circular arrangement of the even number of coaxial wire pairs 11A-11D and the insulated wires 21. The spaces between the insulated wires 21 and 25 and the coaxial wires 11 are filled with a tension fiber 31 which is a large number of aramid fibers, a filler 32 made of a rayon fiber yarn, or the like. The plural insulated wires 21 and 25, the even number of coaxial wire pairs 11A-11D, and, for example, the tension fiber 31 are twisted together spirally.

A wrapping 41 is wound around the thus-assembled insulated wires 21 and 25 and coaxial wires 11, whereby the insulated wires 21 and 25 and the coaxial wires 11 are bundled together so as not to be disordered in arrangement.

The insulated wires 21 and 25 and the coaxial wires 11 are covered with a shield 42 with the wrapping 41 interposed in between. And, the shield 42 is covered with an overall sheath 30.

The wrapping 41 is formed by a conductive resin tape, for example. The base resin of the conductive resin tape is made of a fluororesin such as a polytetrafluoroethylene (PTFE) resin, a polyester resin such as a polyethylene terephthalate (PET) resin, or polyethylene (PE), which is superior in heat resistance, abrasion resistance, etc. To make the wrapping 41 (conductive resin tape) conductive, a conductive substance such as carbon is mixed dispersively into the base resin. The wrapping 41 is in a film form having a prescribed thickness. The winding direction of the wrapping 41 may be either the same as or opposite to the direction of twisting the insulated wires 21 and 25 and the coaxial wires 11 together. It is desirable that to form the wrapping 41 the conductive resin tape be wound with an overlap width that is equal to ¼ to ½ of its width and at a winding angle that forms 15° to 40° with the cable longitudinal direction. It is desirable that the conductive resin tape be wound while receiving tension of 1 to 5 N.

For example, the shield 42 is formed by spirally wrapping or braiding a tin-plated copper wire or a copper alloy wire of several tens of micrometers in outer diameter. The shield 42 prevents noise introduction into signals traveling through the coaxial wire pairs 11A-11D, and thereby enables correct signal transmission that is free of noise-induced errors. The overall sheath 30 is made of polyvinyl chloride (PVC), a polyolefin resin, or the like. In the multi-core cable 10 of this example having the four coaxial wire pairs 11A-11D (eight small-diameter coaxial wires 11 of AWG #36), the outer diameter of the overall sheath 30 is equal to 3.2 mm. It is preferable that the outer diameter of the multi-core cable 10 be larger than or equal to 2.5 mm and smaller than about 5 mm. The multi-core cable 10 has skew of 9 ps/m.

Figure 2:
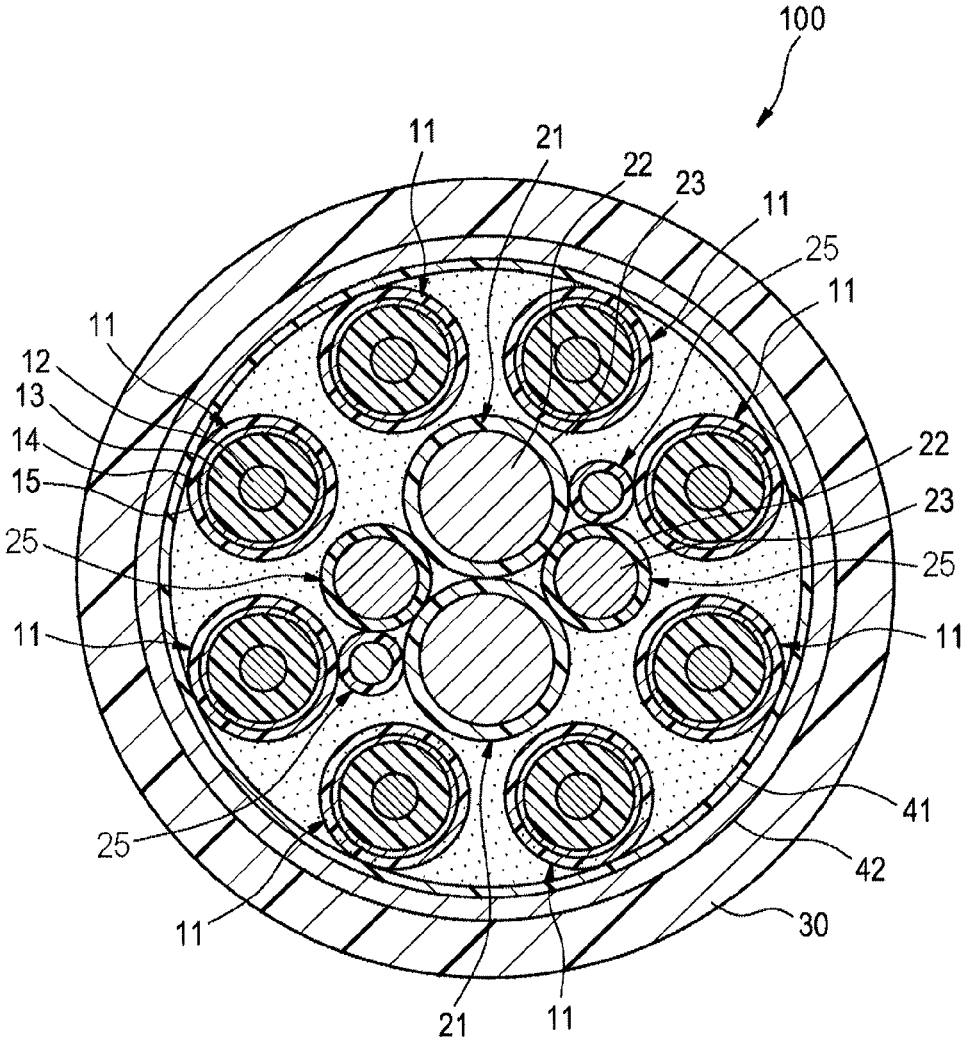
FIG. 2 is a sectional view of an example multi-core cable.

FIG. 2 shows a multi-core cable 100 in which only eight coaxial wires (same in number as the coaxial wires 11 of the multi-core cable 10 according to the embodiment) of AWG #36 (outer diameter: 0.6 mm) are arranged on a single circle and insulated wires that are the same in number as the insulated wires 21 and 25 of the multi-core cable 10 are disposed inside the coaxial wires. The outer diameter of the sheath of the multi-core cable 100 is equal to, for example, 4.0 mm, which is larger than the example outer diameter 3.2 mm of the overall sheath 30 of the multi-core cable 10 according to the embodiment.

To manufacture the above-configured multi-core cable 10 according to the embodiment, first, plural small-diameter insulated wires 25 are arranged close to each other around the center in a cable transverse cross section. Then an even number of coaxial wire pairs 11A-11D and plural large-diameter insulated wires 21 are arranged around the insulated wires 25 on a single circle. At this time, the plural large-diameter insulated wires 21 are arranged at equal intervals, and the even number of coaxial wire pairs 11A-11D are arranged between the large-diameter insulated wires 21 such that one or an even number of coaxial wire pairs are arranged between the insulated wires 21 on each side. Then the spaces between the coaxial wire pairs 11A-11D and the insulated wires 21 and 25 are filled with a tension fiber 31, a filler 32, or the like. Subsequently, the coaxial wire pairs 11A-11D and the insulated wires 21 and 25 are twisted together. A wrapping 41 is wound around a resulting structure and a shield 42 is formed around the wrapping 41. Finally, the shield 42 is covered with an overall sheath 30, for example, by extrusion molding.

In the multi-core cable 10 according to the embodiment, among the plural insulated wires 21 and 25, the small-diameter insulated wires 25A-25D are arranged around the cable center in a cable transverse cross section. And, the even number of coaxial wire pairs 11A-11D (even number of pairs of coaxial wires 11) and the large-diameter insulated wires 21A and 21B are arranged around the small-diameter insulated wires 25A-25D on a single circle. With this configuration, the even number of coaxial wire pairs 11A-11D and the large-diameter insulated wires 21A and 21B can be arranged close to each other on a single circle and the small-diameter insulated wires 25A-25D can be provided efficiently inside that the circular arrangement. Thus, the multi-core cable 10 can be miniaturized.

Where the large-diameter insulated wires 21 are disposed in a central region in a cable transverse cross section together with the small-diameter insulated wires 25 as in the multi-core cable 100 shown in FIG. 2 unlike in the embodiment, the coaxial wires 11 which are disposed around the insulated wires 21 and 25 are arranged so as to be spaced from each other. As a result, the coaxial wires 11 may deviate from the prescribed positions when the coaxial wires 11 and the insulated wires 21 and 25 are twisted together.

In contrast, in the multi-core cable 10 according to the embodiment, since the even number of coaxial wire pairs 11A-11D and the plural insulated wires 21 which are located on the single circle are arranged with no gaps formed in between, positional deviations can be avoided even when they twisted together. As a result, the coaxial wires 11 and the insulated wires 21 and 25 require no rearrangement work, whereby the multi-core cable 10 can be terminated easily and the processing cost can be reduced.

The even number of coaxial wire pairs 11A-11D and the plural large-diameter insulated wires 21 are arranged around the plural small-diameter insulated wires 25 on the single circle, and the spaces between them are filled with the tension fiber 31. As a result, the outer diameter of the multi-core cable 10 can be made smaller than in a conventional cable structure in which a tension member is provided in a central region in a transverse cross section. When the multi-core cable 10 is bent, distortion scarcely occurs in the insulated wires 21 and 25 or the coaxial wire pairs 11A-11D. And, disconnection hardly occurs in the insulated wires 21 and 25 or the coaxial wire pairs 11A-11D even if the multi-core cable 10 is bent repeatedly. Further, since the arrangement of the coaxial wires 11A-11D is stable, the skew remains small and hence good electrical characteristics can be obtained. Still further, since the plural insulated wires 21 and 25, the even number of coaxial wire pairs 11A-11D, and the tension fiber 31, the filler 32, or the like are wholly twisted, as a result of which the arrangement of the coaxial wires 11A-11D is made more stable.

In the multi-core cable 10, since the wrapping 41 is formed by wrapping the conductive resin tape around the coaxial wires 11 for high-speed transmission, the wrapping 41 and the shield 42 formed around it minimizes increase of the signal attenuation in the coaxial wires 11, whereby good electrical characteristics can be obtained. As such, the multi-core cable 10 can be used suitably as a cable for transmitting differential signals in a high frequency band.

Examples

The above-described multi-core cable 10 was evaluated in terms of skew and workability by changing the pigment used in the insulator 13 of the coaxial wire 11. More specifically, coaxial wires of Examples 1-7 shown in Table 1 were evaluated for the skew and the damage of the insulator and the inner conductor caused by cutting the outer conductor using a YAG laser.

Results are shown in Table 1. In the coaxial wire of Example 1, the fluororesin of the insulator contains no pigment such as carbon black and hence the insulator is not colored. In the coaxial wire of Example 2, the fluororesin of the insulator contains a yellow pigment (titanium-nickel-niobium composite oxide) at 0.5 wt % and the insulator is thereby colored yellow. In the coaxial wire of Example 3, the fluororesin of the insulator contains a white pigment (titanium oxide) at 0.5 wt % and the insulator is thereby colored white. In the coaxial wire of Example 4 which corresponds to the above-described embodiment, the fluororesin of the insulator contains a black pigment (carbon black) at 0.25 wt % and the insulator is thereby colored light black. In the coaxial wire of Example 5, the fluororesin of the insulator contains a black pigment at 0.17 wt % and the insulator is thereby colored light black that is even lighter than in Example 4. In the coaxial wire of Example 6, the fluororesin of the insulator contains a gray pigment (titanium oxide) at 0.5 wt % and the insulator is thereby colored gray. In the coaxial wire of Example 7, the fluororesin of the insulator contains a gray pigment at 0.25 wt % and the insulator is thereby colored light gray that is lighter than in Example 6.

TABLE 1

| | | Ex. 1 | Ex. 2 | Ex. 3 | Ex. 4 | Ex. 5 | Ex. 6 | Ex. 7 |
|---|---|---|---|---|---|---|---|---|
| | | | | | Content | | | |
| | | No pigment | Yellow 0.5 wt % | White 0.5 wt % | Black 0.25 wt % | Black 0.17 wt % | Gray 0.5 wt % | Gray 0.25 wt % |
| Delay time | Max (ns/m) | 4.745 | 4.688 | 4.727 | 4.731 | 4.740 | 4.727 | 4.754 |
| | Min (ns/m) | 4.739 | 4.675 | 4.716 | 4.722 | 4.731 | 4.713 | 4.749 |

TABLE 1-continued

| | Ex. 1 | Ex. 2 | Ex. 3 | Ex. 4 | Ex. 5 | Ex. 6 | Ex. 7 |
|---|---|---|---|---|---|---|---|
| | | | | Content | | | |
| | No pigment | Yellow 0.5 wt % | White 0.5 wt % | Black 0.25 wt % | Black 0.17 wt % | Gray 0.5 wt % | Gray 0.25 wt % |
| Average (ns/m) | 4.741 | 4.682 | 4.721 | 4.727 | 4.735 | 4.720 | 4.751 |
| Standard deviation (ps/m) | 1.5 | 3.2 | 3.6 | 2.9 | 2.1 | 4.0 | 2.1 |
| Skew (ps/m) | 5.5 | 13.0 | 11.0 | 9.0 | 8.5 | 13.5 | 5.0 |
| Workability | x | ○ | ○ | ○ | x | ○ | x |

As seen from Table 1, the skew values of all of Examples 1-7 are smaller than 16 ps/m and hence are proper. The standard deviations of the delay times are smaller than 4.0 ps/m. It is therefore concluded that Examples 1-7 are free of a problem that each coaxial wire deviates from its prescribed position in the multi-core cable. As for the workability of YAG laser cutting, in Examples 2-4 and 6, no damage was found in the insulator or the inner conductor even when the outer conductor was cut using a YAG laser. On the other hand, in Examples 1, 5, and 7, damage was found in the insulator or the inner conductor. It is therefore concluded that the insulator of any of Examples 2-4 and 6 can be used suitably as the insulator 13 to be used in the embodiment in the sense that neither the insulator nor the inner conductor is damaged.

Although the embodiment has been exemplified, various changes and modifications are possible without departing from the spirit and scope of the invention.

The numbers and the arrangement forms of the coaxial wires 11 and the insulated wires 21 of the multi-core cable 10 are not limited to those employed in the embodiment. For example, a configuration is possible in which an even number of coaxial wire pairs (plural coaxial wires 11) and large-diameter insulated wires 21 are arranged on plural circles and small-diameter insulated wires 25 are provided inside those circular arrangements.

The invention claimed is:

1. A multi-core cable comprising:

first insulated wires;

second insulated wires which are smaller in diameter than the first insulated wires;

coaxial wire pairs including an even number of pairs of coaxial wires; and a sheath which wholly covers the first insulated wires, the second insulated wires and the coaxial wire pairs, wherein each of the first insulated wires consists of a conductor being twisted wires and a sheath covering the conductor, wherein the first insulated wires and the coaxial wire pairs are arranged close to each other on a single circle in a cross section taken perpendicularly to a cable longitudinal direction of the multi-core cable, wherein the second insulated wires are disposed inside the circular arrangement of the first insulated wires and the coaxial wire pairs, wherein the first insulated wires, the second insulated wires and the coaxial wire pairs are wholly twisted, and wherein a space between the coaxial wire pairs, the first insulated wires and the second insulated wires are filled with a tension member.

2. The multi-core cable of claim 1, wherein the first insulated wires are arranged on the single circle at equal intervals, and wherein the coaxial wire pairs are disposed between the first insulated wires which are spaced from each other.

3. The multi-core cable of claim 1, wherein each of the coaxial wires includes an inner conductor, an insulator, an outer conductor, and a sheath, and wherein the insulator is made of a fluororesin containing carbon black at 0.15 to 0.35 wt %.

4. A manufacturing method of a multi-core cable comprising:

arranging first insulated wires and coaxial wire pairs including an even number of pairs of coaxial wires close to each other on a single circle in a cross section taken perpendicularly to a cable longitudinal direction, the first insulated wires consisting of a conductor being twisted wires and a sheath covering the conductor;

disposing second insulated wires which are smaller in diameter than the first insulated wires inside the circular arrangement of the first insulated wires and the coaxial wire pairs;

filling a space between the coaxial wire pairs, the first insulated wires and the second insulated wires with a tension member;

wholly twisting the first insulated wires, the second insulated wires and the coaxial wire pairs; and after twisting, wholly coving the first insulated wires, the second insulated wires and the coaxial wire pairs.

5. The manufacturing method of claim 4, wherein the first insulated wires and the coaxial wire pairs are arranged on the single circle such that the first insulated wires are arranged on the single circle at equal intervals, and wherein the coaxial wire pairs are disposed between the first insulated wires which are spaced from each other.

6. The manufacturing method of claim 4, wherein the tension member is a tension fiber, and wherein the tension member is twisted together with the first insulated wires, the second insulated wires and the coaxial wire pairs.

* * * * *